United States Patent [19]

Lavezzari

[11] Patent Number: 4,548,872

[45] Date of Patent: Oct. 22, 1985

[54] PROTECTION PROCESS OF FLAT ROLLED STEEL SECTIONS BY MEANS OF MULTI-LAYER ELECTROLYTIC PLATING IN PARTICULARLY AGGRESSIVE ENVIRONMENTS

[75] Inventor: Carlo Lavezzari, Varzi, Italy

[73] Assignee: Zincroksid S.p.A., Turin, Italy

[21] Appl. No.: 633,796

[22] Filed: Jul. 24, 1984

[30] Foreign Application Priority Data

Aug. 11, 1983 [IT] Italy ..... 22517 A/83

[51] Int. Cl.[4] ..... C03C 27/02; C03C 27/04; C25D 7/00

[52] U.S. Cl. ..... 428/633; 428/659; 428/667; 204/27; 204/28; 204/38.4; 204/41; 204/56 R

[58] Field of Search ..... 204/27, 28, 41, 38.4, 204/56 R; 428/632, 659, 667, 633

[56] References Cited

U.S. PATENT DOCUMENTS

| | | | |
|---|---|---|---|
| 3,616,303 | 10/1971 | Carter | 204/41 |
| 3,816,082 | 6/1974 | Austin | 204/28 |
| 4,437,944 | 3/1984 | Bruno | 204/27 |

*Primary Examiner*—John F. Niebling

*Attorney, Agent, or Firm*—Robert E. Burns; Emmanuel J. Lobato; Bruce L. Adams

[57] ABSTRACT

An improved process for the protection of flat rolled steel sections in the form of bands, plates or sheets in particularly aggressive environments is disclosed. According to applicant's copending U.S. patent application Ser. No. 585,856, filed Mar. 2, 1984, U.S. Pat. No. 4,520,077, steel plates previously plated with zinc or zinc alloys are, as such, plated with layers of an electrolytic plating consisting of inorganic elements or compounds, preferably chromium metal and chromium oxide. The improvement according to this invention comprises a chemical passivation in a chrome anhydride solution of the zinc base plating layer, prior to carrying out the successive multi-layer electrolytic plating of inorganic elements or compounds.

17 Claims, 6 Drawing Figures

(x 1)

(x 200)

(x 1000)

(x 1)

(x 200)

(x 1000)

PROTECTION PROCESS OF FLAT ROLLED STEEL SECTIONS BY MEANS OF MULTI-LAYER ELECTROLYTIC PLATING IN PARTICULARLY AGGRESSIVE ENVIRONMENTS

BACKGROUND OF THE INVENTION

This invention relates to an improved process, and the consequent product, which provides the greatest degree of corrosion protection of flat rolled steel sections, previously galvanized and successively plated with multi-layer electrolytic deposits.

Applicant's copending U.S. patent application Ser. No. 585,856, filed Mar. 2, 1984 U.S. Pat. No. 4,520,077 relates to the electrolytic deposit of one or more layers of inorganic elements or compounds on top of the zinc-base layer constituting the first steel plating layer.

In particular, according to the said process, the electrolytic plating consists of a metal chrome layer and a chrome oxide layer, said plating being obtained by a two-stage electrolytic process carried out continuously in the end portion of a hot galvanizing plant through a dipping or electrogalvanizing plant, wherein zinc or zinc alloys are deposited, whatever the plant characteristics, or even in an autonomous plant, independent of any other plating plant, whether upstream or downstream.

Under these multi-layer plating conditions (zinc or zinc alloys, chrome or chrome oxide) in case of exposure to particularly aggressive environments or solutions, e.g.; acid solutions, there may take place local attacks according to the following mechanism:

After deformations due to the fact that the steel is pressed with a multi-layer plating, crackings of the chrome based layers may form. As a result, the zinc, being the first protection layer, is exposed to environment attacks. The condition is not in itself worrying, both because the multi-layer pre-plated steel is intended for uses involving painting of the goods, and because the zinc itself provides a very good protection action even in the absence of chrome or chrome oxide, and finally because the cracks are microscopic. However, in the event that, before painting, the product made with multi-layer pre-plated steel is submitted to particularly aggressive agents, such as, for instance, acid solutions having a pH lower than 3, the zinc and consequently the plating may be attacked. For instance, such acid solutions may consist in the phosphoric acid solutions used to make an anchoring layer to the successive paint layer, to be applied to a car body. This phosphoric acid treatment provides to be necessary for uncoated sheet-steels. However for economic reasons, in view of the fact that even when pre-coated steel sheets are used of the type specified in U.S. Pat. No. 4,520,077 such multicoated sheets are used only for car parts most vulnerable to environmental attack. Consequently, the phosphoric acid treatment is applied to the body to be painted, including the parts pre-coated according to U.S. Pat. No. 4,520,077. If during forging, microcracks have formed on the said pre-coated pieces uncovering the zinc layer, local corrosion may occur as described hereinafter.

The chromium and chromium oxide layers are particularly resistant to acid agressive agents; therefore, they protect the zinc until there are no microflaws in the said nobler layers. However for a number of reasons (pressing, abrasion, microdefects) there may turn out to be micro-discontinuities in the chromium base layers.

When this happens, the highly protective condition may change into a serious acceleration of the zinc dissolution on the part of the aggressive agent; indeed, there may be the well known "pitting" condition, due to the presence of a wide cathodic area (the chrome and chrome oxide plated area) together with a number of tiny anodic areas (those where the zinc is unplated), with the added inconvenience that the aggressive power of the corrosive agent concentrates on the latter, and determines its dissolution, that continues below the areas plated with Cr—CrOx.

Depending on the length of exposition to the aggressive solution, a global attack on the multi-layer plating (Zn—Cr—CrOx), causes the steel to be uncovered in various spots. For instance, a 5 minute dip into a phosphating bath having a pH of 2.5 containing chlorates as accelerators, is enough to cause pitting of the multilayer plating.

In the following specification, as in the preceding one, the words "steel", "zinc-based plating", "galvanized steels" or "zinc-plated steels", "galvanizing" and "multi-layer" have the same meanings as those previously specified and defined in the said U.S. Pat. No. 4,520,077.

OBJECT OF THE INVENTION

The scope of this invention is an improved protection process—in particularly aggressive environments—of flat rolled steel sections, plated with layers of an electrolytic plating consisting of inorganic elements or compounds, preferably chromium metal and chromium oxide, so as to prevent them from pitting.

This and other aspects of the invention will be clear to the experts in the art, from the following specifications and claims.

SUMMARY OF THE INVENTION

The improved process according to the invention comprises the deposit on flat rolled steel sections, plated with zinc or zinc alloys, of layers of a multi-layer electrolytic plating consisting of inorganic elements or compounds, as specified in the above mentioned U.S. Pat. No. 4,520,077 and is substantially characterized in that it provides for the chemical passivation in a chrome anhydride solution of the zinc base plating layer of the said flat rolled steel sections prior to the said multi-layer electrolytic plating.

BRIEF DESCRIPTION OF DRAWINGS

Photographs 1, 2 and 3 show, in progressively greater enlargements, the non-passivated multi-layer electrolytic galvanized flat rolled section Zn—Cr—CrOx attacked in form of "pitting" by a chlorate acid phosphating solution.

Photographs 4, 5 and 6 show, in the same enlargement, the passivated (according to the invention) multi-layer electrolytic galvanized flat rolled section Zn—Cr—CrOx, not attacked by the chlorate acid phosphating solution, in this case the "pitting" being avoided.

DESCRIPTION OF A PREFERRED EMBODIMENT

Figure 1:
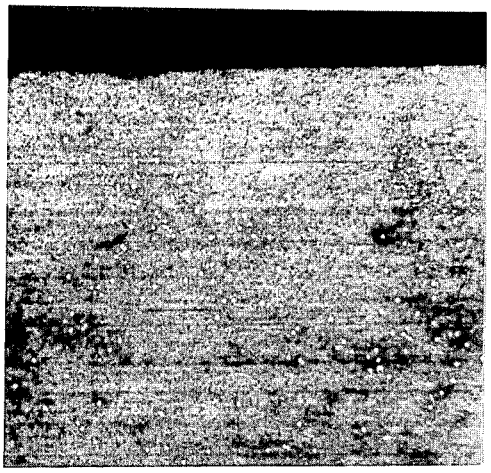
Figure 2:
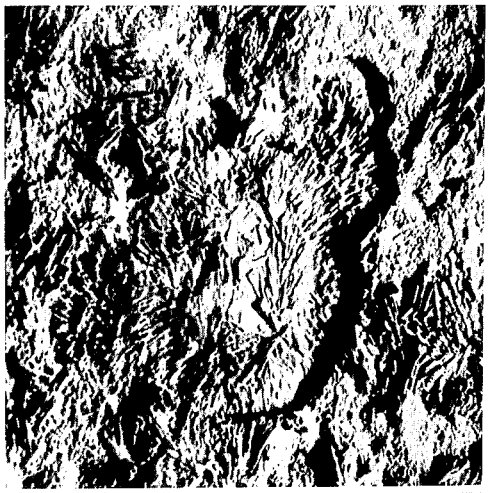
Figure 3:
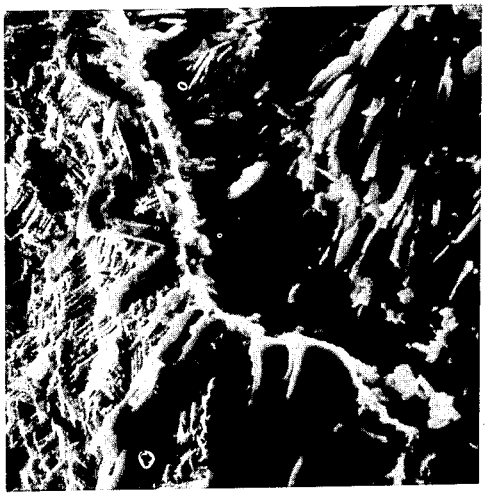
Figure 4:
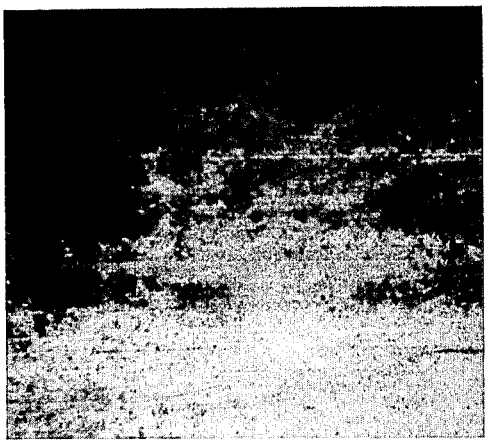
Figure 5:
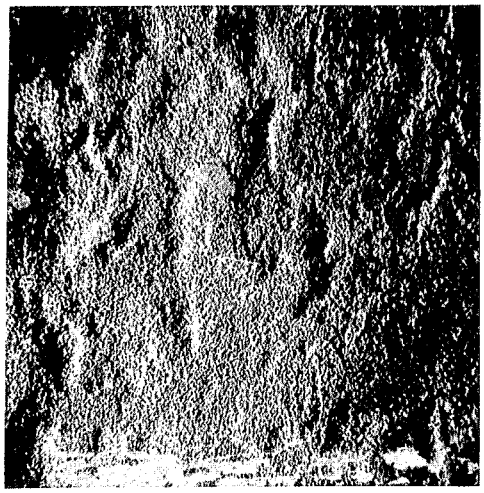
Figure 6:
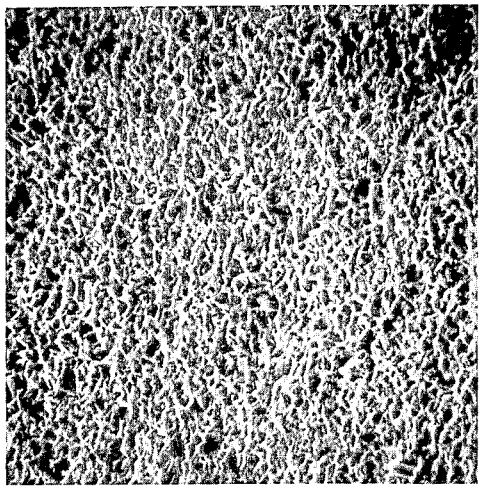

More particularly, according to the invention the chemical passivation of the zinc-based plating layer is carried out with an aqueous solution containing chromium anhydride at 0.15 to 15 g/l concentration, preferably 0.75 to 2.5 g/l and at a temperature comprised between 15° C. and 75° C., preferably between 30° C. and 60° C., the resulting pH being 0.5 to 4, and advantageously 2.5 to 3.5.

Thus, in the event that a zinc surface unprotected by Cr—CrOx, should be attacked by aggressive agents, its resistance will be similar to that of the nobler upper layer, and consequently there will not be any pitting.

It may be observed that chemical passivation, whether strong or weak of galvanized steels by means of chromium anhydride solutions, is per se known; however, the chemical passivation of a zinc plated layer prior to the electrolytic application of the successive layers which lead to a multi-layer pre-plated steel is an absolute innovation, and constitutes a new and valid improvement over the process specified in the previously mentioned U.S. Pat. No. 4,520,077.

The flat steel rolled sheet, for example in the form of a band arrives at the galvanizing section, the final stage of which consists in washing with water, advantageously at 40°-60° C.; it can be zinc plated on one face only, or both, so that the zinc passivation treatment will be effected on one face only, or both: at the end of the process, the non-galvanized face will be cleaned from possible reagent marks by mechanical brushing.

The composition of the chromic passivation solutions of zinc based platings is known (as previously said) and there are quite a few suitable products on the market, such as the following:

| COMPANY | Trade name of the chromating solution |
|---|---|
| ITALBONDER | Parcolene 62 |
| BALTIMORE, Md. U.S.A | Iridite N° 4-2 |
| AZED | Azed 2032 |
| THE CHEMICAL Corp. | Lusteron |
| PROMAT Division | Proseal |
| WANKLEGEN | Promat D 32 A |
| UDYLITE Corp. | Sustreat Zinc 100 |
| UNITED CHROMIUM | Unichrome 1080 A |
| UNITED CHROMIUM | Unichrome 1080 B |

The amount of zinc passivation is a function of the concentration of chromic anhydride in an aqueous solution, of the solution temperature and of the treatment times. On the basis of experiments, it has been observed that the kind of passivation most suited to attain an optimal multi-layer pre-plating is light passivation.

More particularly, the concentration of chromic anhydride in an aqueous solution is 0.15 to 15 g/l, advantageously 0.75 to 2.5 g/l, it being possible to add to this solution activators, such as sulphuric acid, nitric acid—and specific organic and inorganic catalysts, as in the chromating solutions found on the market and listed above, by way of example only.

The pH of the resulting solution is 0.5 to 4, advantageously 2.5 to 3.5, and the bath temperature is 15° C. to 75° C., advantageously 30° C. to 60° C.

The optimal treatment time is given by the advancement speed of the flat rolled section, and by its area to be washed with or preferably, dipped into the chromium solution. The treatment times may vary from 0.5 to 25 seconds, and the bath temperature and concentration will vary accordingly.

The best concentration is of the "light" type, causing a "light" coloring of the galvanized layer. Experiments were also made with "strong" chromation, of "yellow" color; but the product results, in terms of resistance to acid aggression, do not justify the greater and costlier use of reagents.

In the process, after dipping the galvanized section into the chromating solution and before the multi-layer electro deposit, it is advisable to provide for hot air drying at 50°—70° C.: this leads to an advantageous stabilization of the passivating film. Possible washing operations prior to drying, should be with cold water, so as to prevent the unstabilized passivating film from dissolving. Once passivated and stabilized, the galvanized section is ready for the multi-layer electrolytic plating specified in the above said U.S. Pat. No. 4,520,077.

The object of this invention, as specified above, is to make the multi-layer Zn—Cr—CrOx more resistant to the attack of aggressive acid solutions in a hot state, such as for instance pH 2.5 phosphatation baths, containing chlorates for their accelerating function.

The verification of the product obtained with the process specified in the invention was made by comparing the behavior during five minutes dipping of multi-layer galvanized flat rolled sections wherein the first layer had a non-passivated zinc base U.S. Pat. No. 4,520,077 and a passivated zinc base (this invention).

As can be seen in photographs 1, 2 and 3, the non-passivated multi-layer electrolytic galvanized flat rolled section Zn—Cr—CrOx is attacked in form of "pitting" by the chlorate acid phosphating solution; whereas as can be seen in photographs 4, 5 and 6 the product forming the object of this invention, thanks to the galvanized layer, chemically passivated and successively deposited with electrolytic Cr—CrOx shows no evidence of pitting.

This example is probatory in terms of evaluation of the fundamental importance of the passivation of the zinc base layer to prevent galvanic corrosion cells from coming into being between Cr—CrOx and Zn layers. With regard to application results, a multi-layer galvanized section with a first passivated layer shows higher resistance to blistering in general; its use proves to be absolutely necessary in those cases when prior to painting, conversion treatments were adopted, inclusive of dipping into acid and hot solutions (60°) particularly with chlorate contents.

What we claim is:

1. An improved process for the protection, in particularly corrosive environments, of flat rolled steel sections which have a zinc base plating layer composed of zinc or zinc alloys and wherein a multi-layer electrolytic plating of a layer consisting of metal chromium and thereover a layer consisting of chromium oxide is deposited on the zinc base plating layer, comprising chemically passivating the zinc base plating layer of said flat rolled steel sections in a chromic anhydride solution prior to effecting said multi-layer electrolytic plating.

2. The process according to claim 1, in which the chemical passivation of the zinc base plating layer is carried out with an aqueous solution containing chromic anhydride in an amount of 0.15 to 15 g./l.

3. The process according to claim 2 in which the temperature of the aqueous solution is 15° C. to 75° C.

4. The process according to claim 3 in which the pH of said aqueous solution is 0.4 to 4.

5. The process according to claim 2 in which the optimal treatment time of the zinc base plating layer with the chromic anhydride solution is a function of the advancement speed of the flat rolled steel section, and of the area of the section to be washed with the chromic anhydride solution.

6. The process according to claim 5 in which the treatment time varies from 0.5 to 25 seconds, and in which the bath concentration and temperature are determined as function of the said time within a chromic anhydride concentration of 0.15 to 15 g./l. and a temperature of 15° C. to 75° C.

7. The process according to claim 1 in which the passivation is effected only on the galvanized face of the flat rolled steel section when one face only is zinc-plated, or on both faces, when both are zinc-plated.

8. The process according to claim 7 in which when only one face of the flat rolled steel section is zinc plated, the other face is cleaned from any reagent marks by means of mechanical brushing at the end of the process.

9. The process according to claim 1 in which an organic or inorganic catalyst and/or activator effective to catalyze and/or activate the chromic anhydride solution is added to the chromic anhydride solution to increase the process effectiveness.

10. The process according to claim 5 in which the flat rolled section is contacted with the passivating solution by dipping or by spraying.

11. The process according to claim 1 in which after the treatment with the chromic anhydride solution and before the multi-layer electrodeposition, said flat rolled steel sections are exposed to a hot air drying stage at 50° to 70° C. to stabilize the passivating film.

12. A product obtained according to the process of any one of claims 1 to 11, composed of a flat steel rolled section in form of roll, sheet or plate, up to 2500 mm wide and up to 10 mm thick, one or both faces being plated with a zinc base layer up to 100 mm thick on each plated face in which the said zinc base layer is passivated in a chromic anhydride solution, and in which on the said passivated layer there are a layer of chromium at least 0.005 g./m.$^2$ thick and a layer of chromium oxide at least 0.001 g./m.$^2$ thick, the said chromium and chromium oxide layers being electrolytically applied.

13. The process according to claim 1, in which the chemical passivation of the zinc base plating layer is carried out with an aqueous solution containing chromic anhydride in an amount of 0.75–15 to 2.5 g./l.

14. The process according to claim 2, in which the temperature of the aqueous solution is 30° C. to 60° C.

15. The process according to claim 3, in which the pH of said aqueous solution is 2.4 to 3.5.

16. The process of claim 11, in which the zinc plating layer is washed with cold water after treatment with said chromic anhydride solution but before said hot air drying.

17. The process of claim 1, in which the layer of chromium metal has a thickness of at least about 0.55 g./m.$^2$, the chromium oxide layer has a thickness of at least about 0.035 g./m.$^2$ and the weight ratio of the chromium metal to the chromium contained in the chromium oxide in the respective chromium deposits is from 25:1 to 4:1.

* * * * *